US010619312B2

(12) United States Patent
Lintz

(10) Patent No.: US 10,619,312 B2
(45) Date of Patent: Apr. 14, 2020

(54) METHOD FOR UNDERFILLING A SWITCH POINT

(71) Applicant: PLASSER & THEURER EXPORT VON BAHNBAUMASCHINEN GESELLSCHAFT M.B.H., Vienna (AT)

(72) Inventor: Gerard Lintz, Bening-les-Saint-Avold (FR)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 253 days.

(21) Appl. No.: 15/572,242

(22) PCT Filed: Apr. 9, 2016

(86) PCT No.: PCT/EP2016/000594

§ 371 (c)(1),
(2) Date: Nov. 7, 2017

(87) PCT Pub. No.: WO2016/177446

PCT Pub. Date: Nov. 10, 2016

(65) Prior Publication Data

US 2018/0119363 A1 May 3, 2018

(30) Foreign Application Priority Data

May 7, 2015 (AT) ..... A 285/2015

(51) Int. Cl.
*E01B 27/17* (2006.01)
*E01B 27/12* (2006.01)
*E01B 27/16* (2006.01)

(52) U.S. Cl.
CPC ..... *E01B 27/17* (2013.01); *E01B 27/12* (2013.01); *E01B 27/16* (2013.01); *E01B 2203/10* (2013.01); *E01B 2203/125* (2013.01)

(58) Field of Classification Search
CPC .... E01B 27/16; E01B 27/17; E01B 2203/125; E01B 27/12; E01B 2203/10
See application file for complete search history.

(56) References Cited

U.S. PATENT DOCUMENTS 3,595,170 A * 7/1971 Plasser ..... E01B 27/17 104/12
4,165,693 A * 8/1979 Theurer ..... E01B 27/025 104/12

(Continued)

FOREIGN PATENT DOCUMENTS

AT 391903 B 12/1990
AT 13635 U1 5/2014

(Continued)

OTHER PUBLICATIONS

Hongwei Zhu, "Automatic Recognition System of Railway Sleeper Image", Application of Electronic Technology (Nov. 30, 1999), pp. 20-22, DOI:10.161157/ j.issn.0258-7998—Statement of Relevance.

(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

During the tamping of a switch, a switch section delimited by two adjacent sleepers is photographed in a front machine section for producing a reference photo, and the photo is stored. The stored reference photo is automatically made available on a monitor, positioned in a work cabin, for observation by an operator as soon as the tamping tools are situated above the section of the switch shown by the reference photo.

4 Claims, 1 Drawing Sheet

(56) References Cited

U.S. PATENT DOCUMENTS

| | | | | | |
|---|---|---|---|---|---|
| 4,165,694 | A * | 8/1979 | Theurer | ..... | E01B 27/023 104/12 |
| 4,356,771 | A * | 11/1982 | Theurer | ..... | E01B 27/10 104/12 |
| 4,986,189 | A | 1/1991 | Theurer et al. | | |
| 5,090,329 | A | 2/1992 | Theurer | | |
| 6,311,624 | B1 * | 11/2001 | Theurer | ..... | E01B 27/17 104/2 |
| 6,662,728 | B2 * | 12/2003 | Theurer | ..... | E01B 27/16 104/2 |
| 2018/0119363 | A1 * | 5/2018 | Lintz | ..... | E01B 27/12 |

FOREIGN PATENT DOCUMENTS

| | | |
|---|---|---|
| CN | 2340801 Y | 9/1999 |
| DE | 7022725 U | 2/1973 |
| EP | 0424811 A1 | 5/1991 |

OTHER PUBLICATIONS

Guangxue Chen et al., "Rockets-based Weather Modification Technology", China Meteorological Press, (Jan. 31, 2008) pp. 344-345—Statement of Relevance.

* cited by examiner

METHOD FOR UNDERFILLING A SWITCH POINT

BACKGROUND OF THE INVENTION

Field of the Invention

The invention relates to a method of tamping a switch by immersion of tamping tools into ballast of a track.

Tamping a switch is difficult inasmuch as, due to the irregular course of the rails and auxiliary devices such as wing rails, check rails, signal sensors and the like which are frequently present, the immersion of the tamping tools and the application of track lifting devices is often possible only to a limited extent. This requires a concentrated monitoring of the tamping zone by the operator and great experience for assessing an employability of the said working devices.

According to AT 391 903, it is already known to scan a switch by means of contact-less sensors immediately ahead of the tamping section.

SUMMARY OF THE INVENTION

It is the object of the present invention to provide a method of the kind mentioned at the beginning with which an efficient tamping of a switch is possible while making work easier for the operator.

According to the invention, this object is achieved with a method of the specified type by means of the features cited in the characterizing part of the main claim.

Due to this kind of representation of the sleeper crib, limited in each case to the current work area, the operator is able to quickly recognize existent tamping zones and to assess whether tamping tools can be employed. Above all, it can be decided quickly whether the tamping tools can be immersed into the ballast at least to a reduced extent without damaging the switch. The same possibility for quick assessment is naturally also available for the lifting devices for correcting the position of the switch.

Additional advantages of the invention become apparent from the dependent claims and the drawing description.

BRIEF DESCRIPTION OF THE SEVERAL VIEWS OF THE DRAWING

The invention will be described in more detail below with reference to an embodiment represented in the drawing in which.

DESCRIPTION OF THE INVENTION

Figure 1:
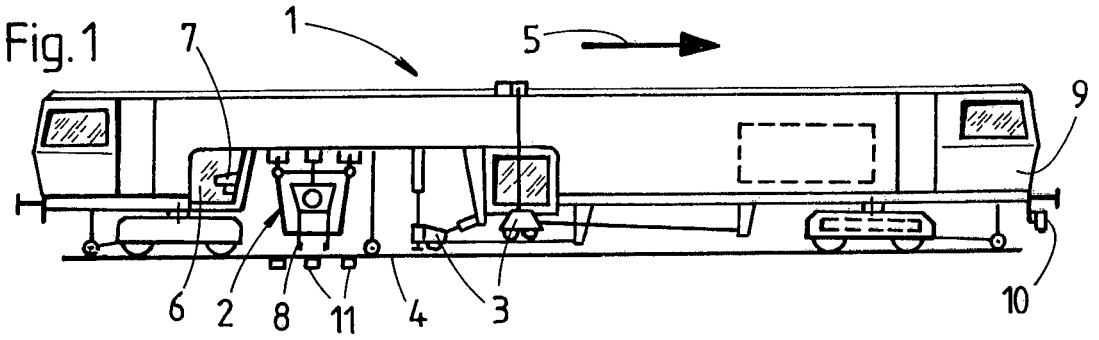
FIG. 1 shows a side view of a switch tamping machine and FIGS. 2 to 5 each show pictures of a switch section appearing on a monitor.
Figure 2:
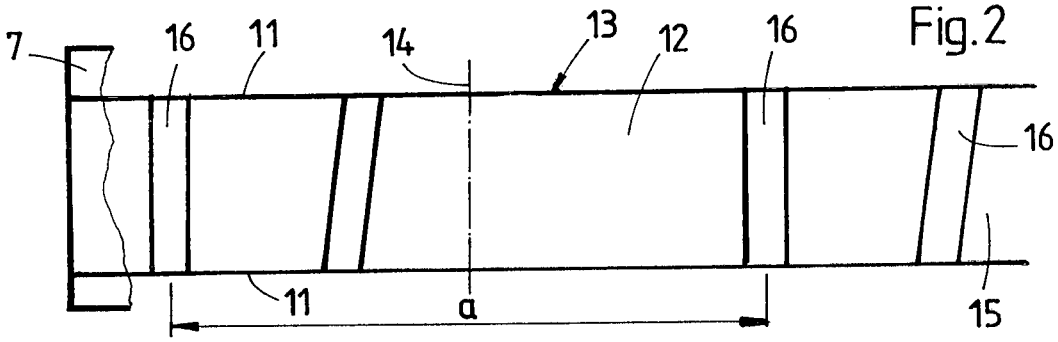
Figure 3:
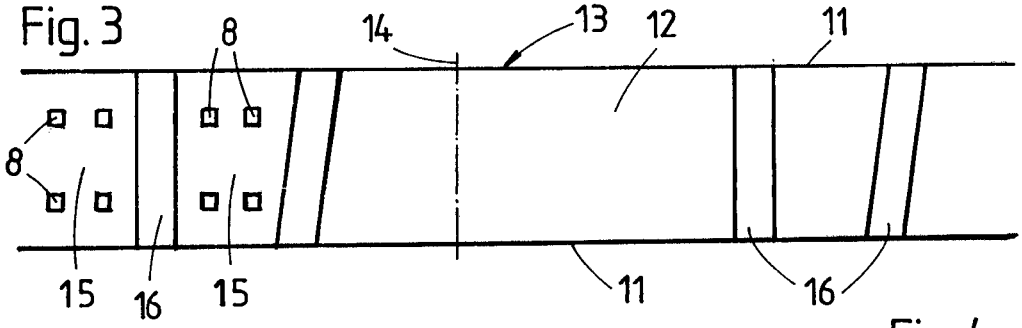

A switch tamping machine 1 shown in FIG. 1 has tamping units 2 which —along with track lifting devices 3—are designed especially for tamping a switch 4. This design has to take into account above all the fact that many tamping and lifting zones are present in the switch 4 which are accessible only in a limited way, or even not at all.

Provided immediately rearward, with regard to a working direction 5, of the tamping units 2, which have tamping tools 8, is a work cabin 6 in which there is located, in addition to various control devices, also a monitor 7 to be observed by an operator. At a front machine section 9 of the switch tamping machine 1, with regard to the working direction 5, an array of photo cameras 10 is arranged.

The method according to the invention will now be described in more detail: As can be seen in FIGS. 2 to 5, a switch section 12 delimited by two adjacent sleepers 11 is photographed in the front machine section 9 during a tamping operation (i.e. with the machine 1 standing still) to produce a reference photograph 13 and stored.

This stored reference photo 13 is automatically made available on the monitor 7, positioned in the work cabin 6, for observation by the operator as soon as the tamping tools 8 are situated above the switch section 12 shown by the reference photo 13.

The reference photo 13 is taken as a top view of the switch section 12 in relation to a reference line 14—defined as track center of the track travelled upon by the switch tamping machine 1—and a reference section a defined by a track gauge.

The operator is now in a position to be able to optimally assess the already mentioned limited situation of possible tamping zones 15 for employing the tamping tools 8.

Figure 4:
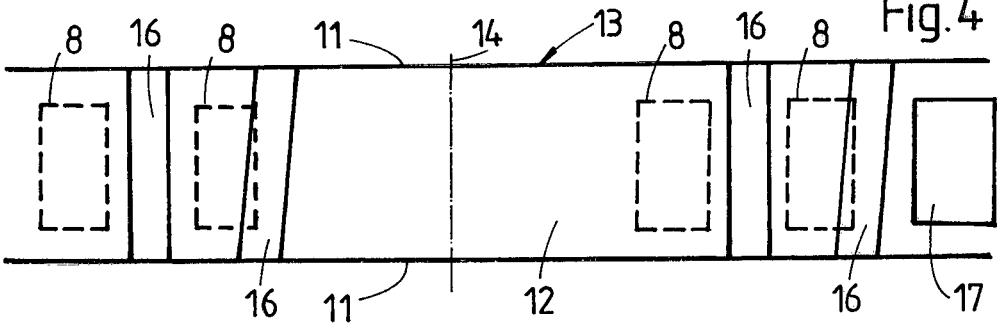

As shown as an advantageous auxiliary aid in FIG. 4, a known position of the tamping tools 8 relative to the switch section 12 can alternatively be superimposed automatically on the reference photo 13 in this manner. Thus, the position of the tamping tools 8 relative to the track or the rails 16 can be recognized precisely by the operator.

The tamping situation shown in FIG. 4 would demonstrate unmistakably that the tamping tools 8 positioned to the right of the rail 16 of a main track in each case cannot be employed since there is a clearly visible overlapping with the adjoining rail 16. A control cabinet 17 present in this switch section 12 precludes any possibility, even limited, of employing the tamping tools 8.

In an alternative embodiment, the tamping tools 8 can also be represented, i.e. superimposed on the photo, in a simplified manner in the shape of a preferably rectangular outline (see FIG. 3) and in the true-to-scale relationship to the reference section a.

Figure 5:
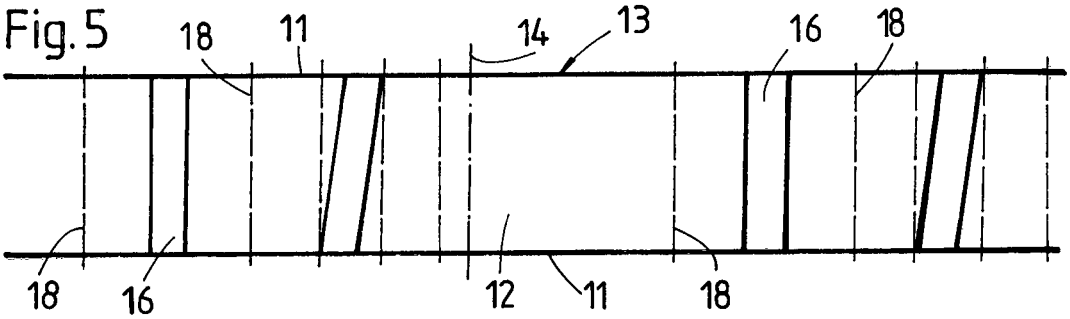

As indicated in FIG. 5, grid lines 18 can also be superimposed on the reference photo 13 as an orientation aid for the operator. These grid lines 18 could, for example, indicate the central position of the tamping tools 8.

The invention claimed is:

1. A method of tamping a switch by immersion of tamping tools into ballast of a track, the method comprising:

in a forward machine section with regard to a working direction, photographing a switch section delimited by two adjacent sleepers for producing a reference photo, and storing the reference photo;

automatically making available the stored reference photo on a monitor, positioned in a work cabin, for observation by an operator when the tamping tools are situated above the switch section of the switch shown by the reference photo;

superimposing a known position of the tamping tools relative to the track on the reference photo to thereby enable the operator to recognize a position of the tamping tools relative to the track; and immersing the tamping tools into the ballast and tamping the ballast in the switch section.

2. The method according to claim 1, which comprises taking the reference photo as a top view of the switch section in relation to a reference line, defined as track center of the track being traveled upon by a switch tamping machine, and a reference section defined by a track gauge.

3. The method according to claim 1, which comprises representing the tamping tools in a simplified manner and in a true-to-scale relationship to the reference section.

4. The method according to claim 3, which comprises displaying the tamping tools in a rectangular outline.

* * * * *